US009718078B1

(12) United States Patent
Chau et al.

(10) Patent No.: US 9,718,078 B1
(45) Date of Patent: Aug. 1, 2017

(54) PIEZOCERAMIC BASED ATOMIZER FOR HIGH VISCOSITY LIQUIDS

(71) Applicant: Acoustic Arc International Limited, Hong Kong (HK)

(72) Inventors: Boa Fung Chau, Hong Kong (HK); Kak Man Chan, Hong Kong (HK); Yaorong Su, Hong Kong (HK)

(73) Assignee: Acoustic Arc International Limited, Hong Kong Science Park, Shatin (HK)

( * ) Notice: Subject to any disclaimer, the term of this patent is extended or adjusted under 35 U.S.C. 154(b) by 0 days.

(21) Appl. No.: 15/281,125

(22) Filed: Sep. 30, 2016

(51) Int. Cl.
*B05B 17/06* (2006.01)
*B05B 17/00* (2006.01)

(52) U.S. Cl.
CPC ..... *B05B 17/0661* (2013.01); *B05B 17/0684* (2013.01); *B05B 17/0646* (2013.01)

(58) Field of Classification Search
CPC ... B05B 17/06; B05B 17/0607; B05B 17/063; B05B 17/0638; B05B 17/0646; B05B 17/0653; B05B 17/0661; B05B 17/0669; B05B 17/0676; B05B 17/0684
See application file for complete search history.

(56) References Cited

U.S. PATENT DOCUMENTS 4,257,989 A 3/1981 Nishikawa
5,300,260 A * 4/1994 Keshet ..... B05B 17/0615 239/102.2
6,296,196 B1 * 10/2001 Denen ..... A01M 1/205 239/102.1
7,467,786 B2 12/2008 Jae-Bong et al.
2004/0200907 A1 * 10/2004 Martens, III ..... B05B 17/0684 239/44
2011/0073673 A1 * 3/2011 Huang ..... B05B 17/0676 239/102.1
2015/0097047 A1 * 4/2015 Hu ..... A61M 11/005 239/4

* cited by examiner

*Primary Examiner* — Darren W Gorman
(74) *Attorney, Agent, or Firm* — Spruson & Ferguson (Hong Kong) Limited

(57) ABSTRACT

A piezoceramic based atomizer for atomizing high viscosity liquid is provided. The atomizer comprises a storing tank as a reservoir for storing the liquid, a receiving tank connecting to the storing tank, a piezoceramic based nozzle for forming micro-droplets of the liquid, and an external ultrasonic oscillation circuit. The nozzle comprises a liquid absorbing medium with at least one sunk area at one end for pumping and delivering the liquid, a holder for holding the absorbing medium, a micro-perforated membrane whose one side is attached on the side of the liquid absorbing medium having the sunk area, and an annular piezoceramic adhered to the other side of the membrane. The nozzle is configured such that the sunk area can balance the feeding rate and atomization rate of the liquid as well as hold the back pressure underneath the micro-perforated membrane, facilitating forming micro-droplets of the high viscosity liquid continuously.

10 Claims, 11 Drawing Sheets

PIEZOCERAMIC BASED ATOMIZER FOR HIGH VISCOSITY LIQUIDS

CROSS-REFERENCE TO RELATED APPLICATIONS

There are no related applications

FIELD OF THE TECHNOLOGY

The present invention relates generally to a device and methods used for forming micro-droplets or mist of high viscosity liquids. More specifically, the present invention relates to a piezoceramic based atomizer and its application for high viscosity liquids nebulization.

BACKGROUND

In many applications, such as disinfection, odour generation and air humidification, liquids or fluids are needed to be dispensed into micro-droplets or aerosols through atomization or vaporization. Normally, for medical purpose, such devices may contain a heating unit or an air compressing pump. However, these devices are generally limited by the decomposition of the medicinal products due to the high temperature, or by the risk of introducing external contamination because of the direct contact of air with medicine, or by the concomitant noise.

To satisfy the special demands of delivering medicines by respiratory pathway, the piezoceramic based atomization technology, i.e., by vibrating a micro-perforated membrane attached to a piezoceramic, is developed by manufacturers these years. Briefly, according to this technique, the micro-perforated membrane contact with a liquid is vibrated at an ultrasonic frequency by an activated piezoceramic, and then the liquid is drawn onto the top surface of the membrane, thus forming a film thereon. The liquid film absorbs vibrational energy from the membrane with vibrating direction perpendicular to the surface, and forms standing waves. As the amplitude of the given vibrational frequency is increased, the waves become unstable, and finally collapse at some critical point. As a result, micro-droplets of liquid are ejected from the films directed normally to the membrane.

However, most of the commercially available piezoceramic based atomization devices are designed for water-based or low viscosity liquids. Actually, many medicinal liquids possess relatively high viscosity, ranging from several tens to more than 300 centipoises (cP), and may not be water-based. Unfortunately, these high viscosity liquids cannot be atomized by aforementioned devices, owing to the fact that the viscous liquid film on the surface of the membrane clogs the micro holes and thus blocking the atomization. Therefore, it would be desirable to develop an effective method that capable of forming micro-droplets from high viscosity liquids by piezoceramic based atomization.

SUMMARY OF THE INVENTION

Accordingly, the first aspect of the present invention relates to a device for forming micro-droplets from high viscosity liquids. In particular, the device of the present invention is a piezocermaic based atomizer. The piezoceramic based atomizer for high viscosity liquids according to one embodiment of the present invention includes: a liquid storing tank used for storing the liquid and a liquid level control system connected to said liquid storing tank for maintaining the height of the stored liquid to a certain level; a receiving tank connected to the control system, used for receiving the liquid from the control system; a nozzle holder fixed to the receiving tank; a specially designed liquid absorbing medium inserted into the nozzle holder in a manner that only one end contacts with liquid, used for pumping and delivering the liquid received by the receiving tank; an atomization unit comprising a micro-perforated membrane and an annular piezoceramic that is adhered, e.g., glued tightly, to the micro-perforated membrane, where the micro-perforated membrane communicates with the other end of the liquid absorbing medium and vibrates at ultrasonic frequency driven by the annular piezoceramic, thereby ejecting droplets of liquid; an external ultrasonic oscillation circuit used for generating an ultrasonic frequency signal to stimulate the annular piezoceramic to drive the micro-perforated membrane to vibrate at said ultrasonic frequency.

One characteristic of the present invention is that the liquid is guided to the rear surface of the micro-perforated membrane by said liquid absorbing medium, which enables the atomizer to operate equally at any angle from vertical to horizontal. Accordingly, the liquid storing tank can be located below, around or above the atomization unit. The liquid absorbing medium can be made of various materials and have different shapes, but is preferably cylindrical. A surface of the liquid absorbing medium is in direct contact with one side of the micro-perforated membrane of the atomization unit, characterized by forming a sunk area in said surface. The sunk area can be either flat or curved, and have one or several separate pits.

The micro-perforated membrane can be made of a variety of materials, such as plastic, silicon and ceramic, but is preferably made of metal, like stainless steel, titanium and aluminum. The membrane can be flat or forming a protuberance of a dome in the central area. The membrane can be in a thickness ranging from 20 um to 400 um. The micro-perforation of the micro-perforated membrane can be processed by electroforming, lasing or chemical etching, ranging from 1 um to 300 um in equivalent diameter and from one to several thousands in quantity according to the demand. The total cross-sectional area of the perforations of the membrane is preferably smaller than the cross-sectional area of the annular piezoceramic.

According to other embodiments of the present invention, a mist guiding tube is provided. The guiding tube is assembled to the nozzle holder, orienting the mist to any demanded direction. The shape of the guiding tube body and the outlet geometry thereof can be arbitrary.

Before explaining the embodiments in detail, it is to be understood that the present invention is not limited in its application to the details of construction and to the assembling sequence of the components in the following description or drawing illustration. It is also understood that the terminology used herein are for better understanding and description and should not be regarded as limiting. At the same time, since various modifications and structural changes may be made by those skilled in the art basing on the conception of the present invention, it is important to include all such modifications in the claims as they do not depart from the spirit and scope of present invention.

BRIEF DESCRIPTION OF THE DRAWINGS

The above and other objects and features of the present invention will become apparent from the following detailed description of the invention, when taken in conjunction with the accompanying drawings, in which.

DETAILED DESCRIPTION OF THE INVENTION

Figure 1:
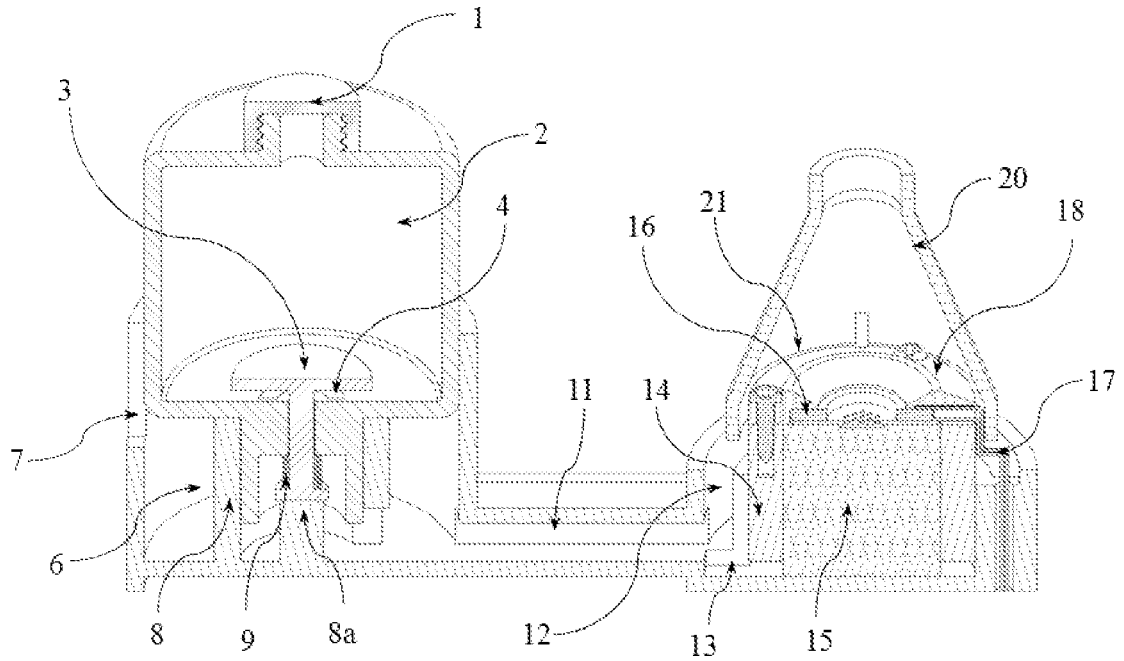
FIG. 1 is a cross-sectional view for the arrangement of the piezoceramic based atomizer for high-viscosity liquids according to a first embodiment of the present invention.

The embodiments of the present invention will now be described in detail with reference to the figures, in which like reference numerals correspond to like parts throughout. FIG. 1 shows the cross-sectional view for the arrangement of the high viscosity liquid piezoceramic based atomizer according to a first embodiment of the present invention. As seen, the atomizer includes a liquid storing tank 2 containing a specially designed valve 3, which can be controlled by a spring 9. When installed, the liquid in the storing tank 2 will flow out through an outlet 4 into a storing trench 6, since the valve 3 is pushed up by a cylinder 8*a*. The liquid will stop flowing out from the storing tank 2 till the exit of the liquid storing tank 2 is sealed by the liquid. The groove 7 functions as both a liquid level observing window and pressure balancing inlet. The liquid storing tank 2 can be refilled from a filling cap 1.

The atomizer illustrated in FIG. 1 also includes a receiving tank 12, connecting with the liquid storing tank 2 by connecting a channel 11. The liquid level in the storing trench 6 keeps the same as that in the receiving tank 12. When the liquid is atomized by the atomizer, the liquid level in the receiving tank 12 will lower, and accordingly, the liquid level lowers in the storing trench 6. When the liquid level falls below the exit of the storing tank 2, the liquid will flow out and air will flow in from the outlet 4 until the pressure is balanced.

Figure 2:
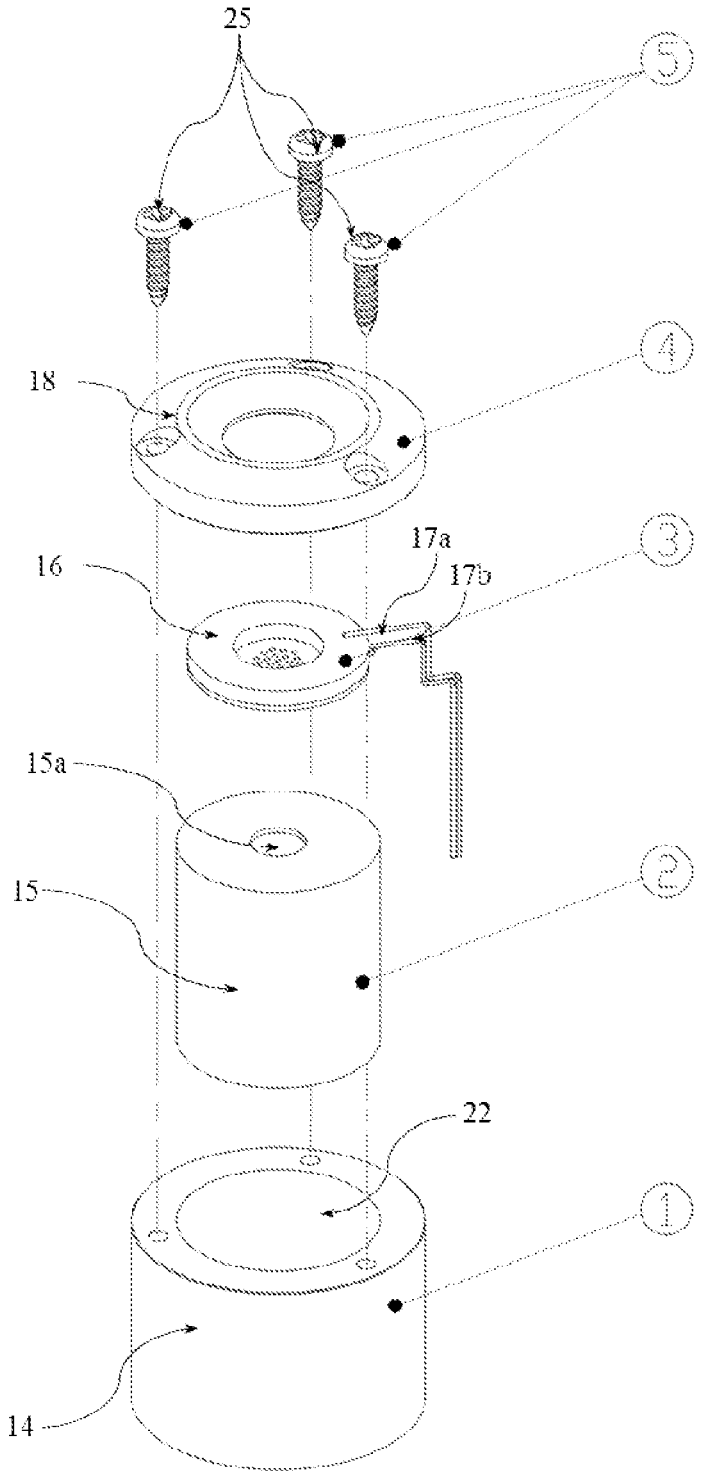
FIG. 2 is an exploded view of the piezoceramic based nozzle according to the first embodiment of the present invention.

As illustrated in FIG. 1, the atomizer also includes a piezoceramic based nozzle fixed in the receiving tank 12, which is the core part of the atomizer. FIG. 2 is an exploded view of the piezoceramic based nozzle according to the first embodiment of the present invention. As seen, the nozzle includes: a hollow cylindrical holder 14 in which a cylindrical liquid absorbing medium 15 is inserted in the center 22; a piezoceramic based atomization unit 16 with two conducting wires 17*a* and 17*b* stacked on the liquid absorbing medium 15, being disposed in such a manner that one side of the micro-perforated membrane 16*b* contacts directly with the top surface (atomizing surface) of the liquid absorbing medium 15; and an annular cap 18 assembled closely with the piezoceramic based atomization unit 16 and cylindrical holder 14 by means of screws 25. By this structure, it is easy to replace the atomization unit 16 when necessary.

Figure 3:
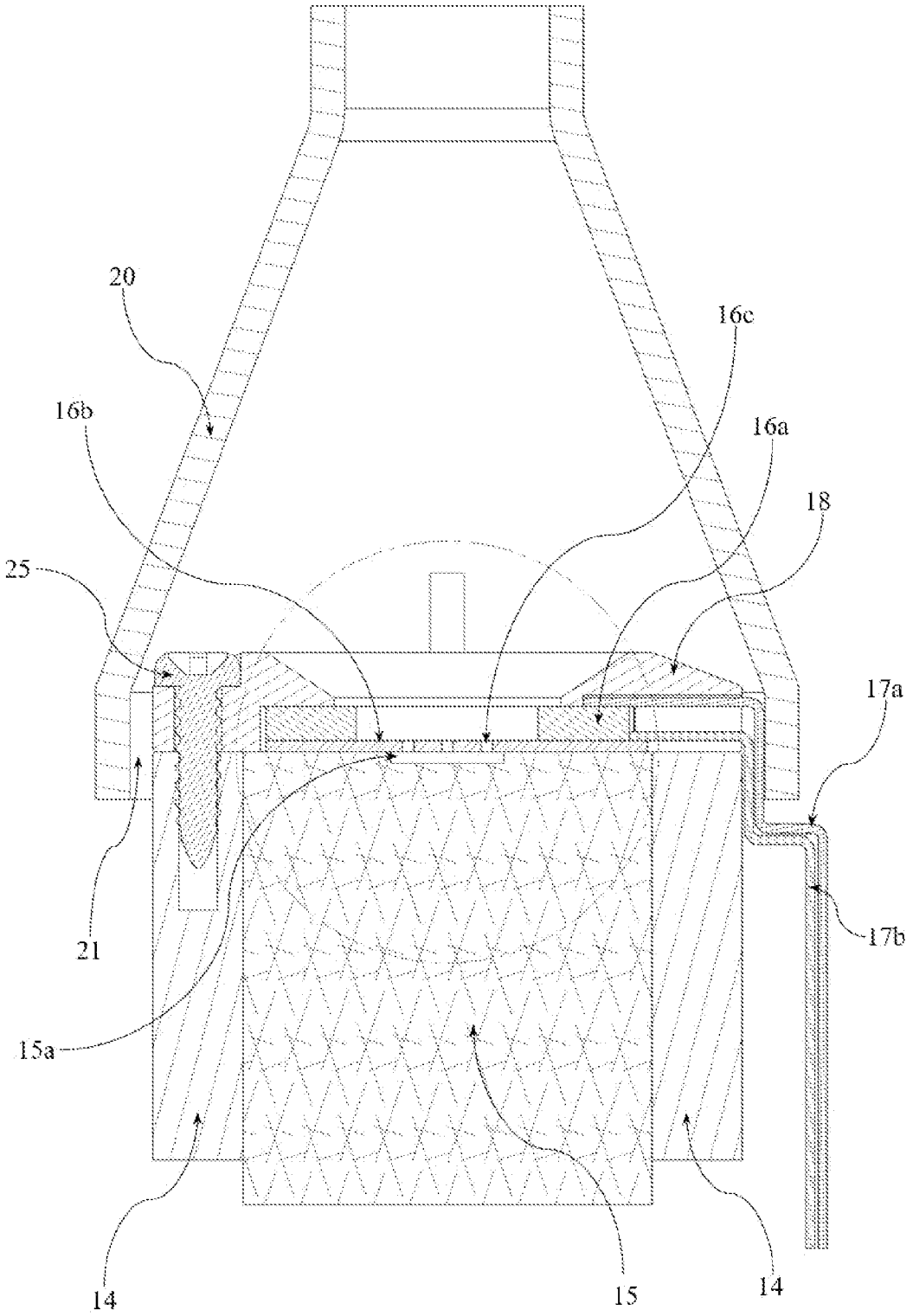
FIG. 3 is a cross-sectional view for showing the arrangement of the piezoceramic based nozzle with a mist guiding tube according to the first embodiment of the present invention.

FIG. 3 shows the cross-sectional view of the piezoceramic based nozzle of the first embodiment according to the present invention. In the center area of top surface of the liquid absorbing medium 15, there is a cylindrical sunk area or inward hollow space 15*a*. The bottom surface of the liquid absorbing medium 15 is immersed into the liquid in the receiving tank 12, for absorbing liquid from slot 13 and then delivering the absorbed liquid to the top surface thereof. The absolute height between the top surface of the absorbing medium 15 and the liquid level in the receiving tank 12 are dependent on the practical applications. The liquid absorbing medium 15 may be made of any material, such as inkjet foam, that can absorb and hold liquid. The piezoceramic based atomization unit 16, comprising an annular piezoceramic 16*a* adhered to a micro-perforated membrane 16*b*, can synchronously vibrate with the external ultrasonic oscillation circuit (not shown) and is configured for atomizing liquid into droplets. The size and geometry of the piezoceramic based atomization unit 16 and the liquid absorbing medium 15 can be varied according to different applications, and the atomization unit 16 may include several groups of ceramic and membrane(s) stacked in cascade. The vibrating frequency of the piezoceramic based atomization unit 16, driven by an external ultrasonic oscillation circuit can range from 50 kHz to 5 MHz, is dependent on the viscosity of the liquid and/or the desired size of the droplets. The external ultrasonic oscillation circuit can produce an output amplitude ranging from 50 V to 500 V.

The nozzle illustrated in FIG. 3 also includes a mist guiding tube 20 that functions to guide the mist to preferred direction and recycle those droplets with large sizes. Those droplets with large sizes will flow down along the mist guiding tube 20 when contacting with its inner wall, and then to the receiving tank 12 through a gap 21 as illustrated in FIG. 1. The exit direction of the mist guiding tube 20 can be arbitrary, from vertical to horizontal, according to certain embodiments of the present invention.

Figure 4:
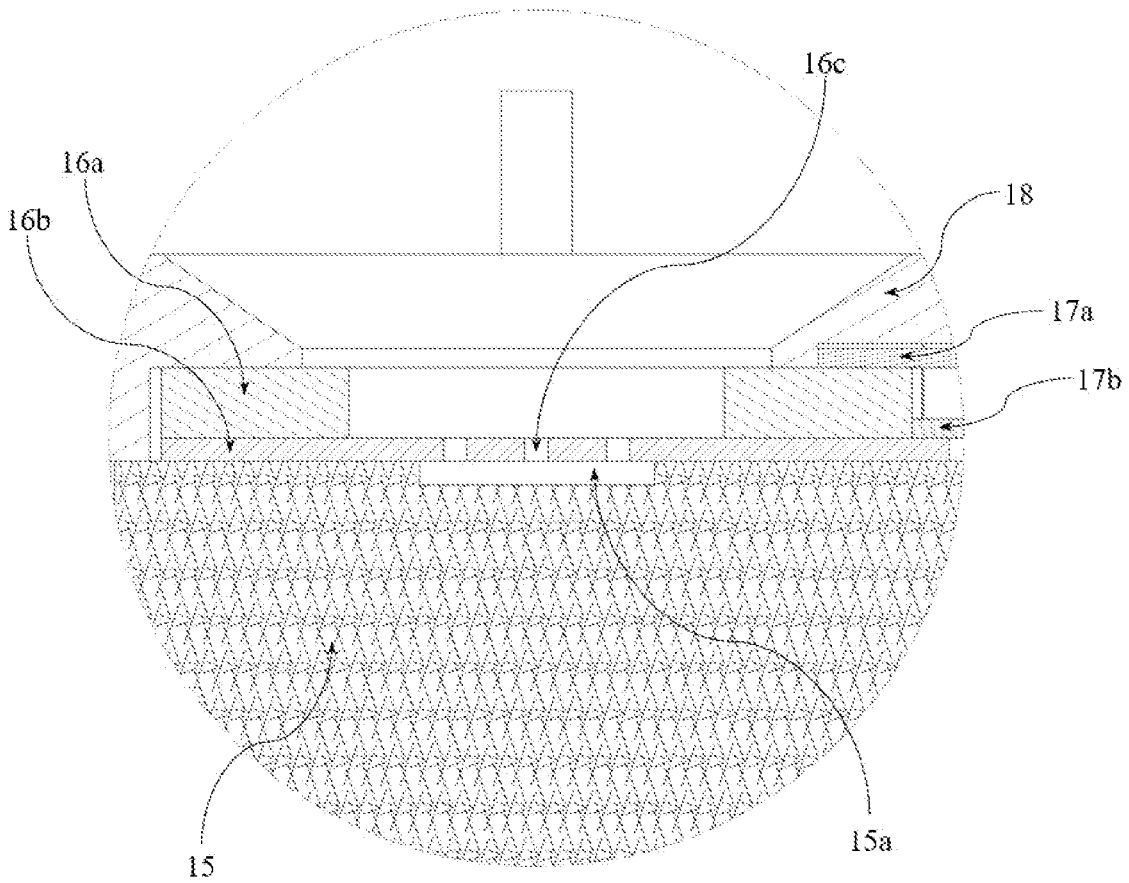
FIG. 4 is a magnified view of the piezoceramic based nozzle illustrated in FIG. 2 marked with dashed circle.

FIG. 4 is the magnified view of selected area as marked in FIG. 3. The materials for the micro-perforated membrane 16*b* can be metals, ceramics or even plastics, provided that they have enough strength under high-frequency vibration, but metal is preferred in this example. The micro-perforation of the micro-perforated membrane 16*b* can be processed by different means but preferably by laser and chemical or electro-etching. The quantity of the micro-holes 16*c* can range from one to several thousands, depending on the desired atomizing intensity, and the diameter of the holes can range from 1 um to 200 um in equivalent size. The metal-based micro-perforated membrane 16*b* is firmly glued onto the surface electrode of the annular piezoceramic 16*a* by conductive adhesive. As shown in FIG. 4, the upper electrode of piezoceramic 16*a* is connected to one output electrode of the external ultrasonic oscillation circuit through a conducting wire 17*a*, and the metal-based micro-perforated membrane 16*b* is connected to the other output electrode of the ultrasonic oscillation circuit by another conducting wire 17*b*.

One characteristic of the present invention is that the micro-perforated membrane 16*b* is connected to a liquid absorbing medium 15, instead of contacting directly with the liquid. When the micro-perforated membrane 16*b* is getting in contact with the liquid absorbing medium 15 saturated with liquid, the liquid will wet the lower surface of the micro-perforated membrane 16*b* which is in direct contact with the liquid absorbing medium 15 and then penetrate from said lower surface to the upper surface (atomizing surface) of the micro-perforated membrane 16*b* through the micro-holes 16*c* because of the capillary effect, and then forming a thin film of the liquid. Upon stimulated by the ultrasonic oscillation circuit, the micro-perforated membrane 16*b* is vibrating at certain frequency, and transferring the vibrating energy to the liquid film, forming a standing wave therein. When the amplitude of the standing wave reaches a critical value, droplets of liquid are ejected from the liquid film in a direction normal to the atomizing surface of the micro-perforated membrane 16*b*. The crictial value of the amplitude of the standing wave is relative to the voltage. That is, the higher the voltage is used, the larger is the amplitude. After atomization occurs, the liquid will continuously be transferred to the atomizing surface of the membrane 16*b* from the liquid absorbing medium 15. With the consumption of liquid, the liquid levels in the receiving tank 12 and the storing channel 6 will be lowered simultaneously. The liquid levels can be controlled by the liquid in the storing tank 2 in the manner described hereinbefore. The liquid absorbing medium 15 also functions as an effective cooling system that dissipating the heat produced by the atomization unit 16.

Another characteristic of the present invention is that a specially designed cylindrical sunk area 15*a* is incorporated into the liquid absorbing medium 15 and disposed at the interface between the liquid absorbing medium 15 and the micro-perforated membrane 16*b*, making the atomizer of the present invention suitable for high viscosity liquids. In traditional piezoceramic based atomizer, the perforations in the micro-perforated membrane are always blocked by the viscous film of high viscosity liquids, owing to the fact that the liquid feeding speed is faster than atomizing speed. On the other hand, this phenomenon also leads to overheating of the piezoceramic based atomization unit 16 if said specially designed cylindrical sunk area 15*a* is absent. The cylindrical sunk area 15*a* in the liquid absorbing medium 15 is configured to control the liquid feeding speed to the atomizing surface of the micro-perforated membrane 16*b*, as well as to keep the back pressure below the membrane. The micro perforations in the membrane 16*b* can be viewed as "capillary tubes", which exert capillary force to pump liquids from the bottom to the top of the membrane. Because of the sunk area 15*a* being disposed underneath the perforations of the micro-perforated membrane 16*b*, these "capillary tubes" cannot pump liquid directly from the liquid absorbing medium 15. As a result, the liquid feeding speed is balanced with the atomization speed by said sunk area 15*a*, and the overheating of piezoceramic based atomization unit 16 can be suppressed simultaneously. At the same time, the sunk area 15*a* can also hold the back pressure below the membrane, ensuring the ejection of droplets occurs on the opposite surface. These properties enable the atomizer of the present invention suitable for high viscosity liquids. The diameter and the depth of the cylindrical sunk area 15*a* can be varied with different applications and liquids.

Figure 5:
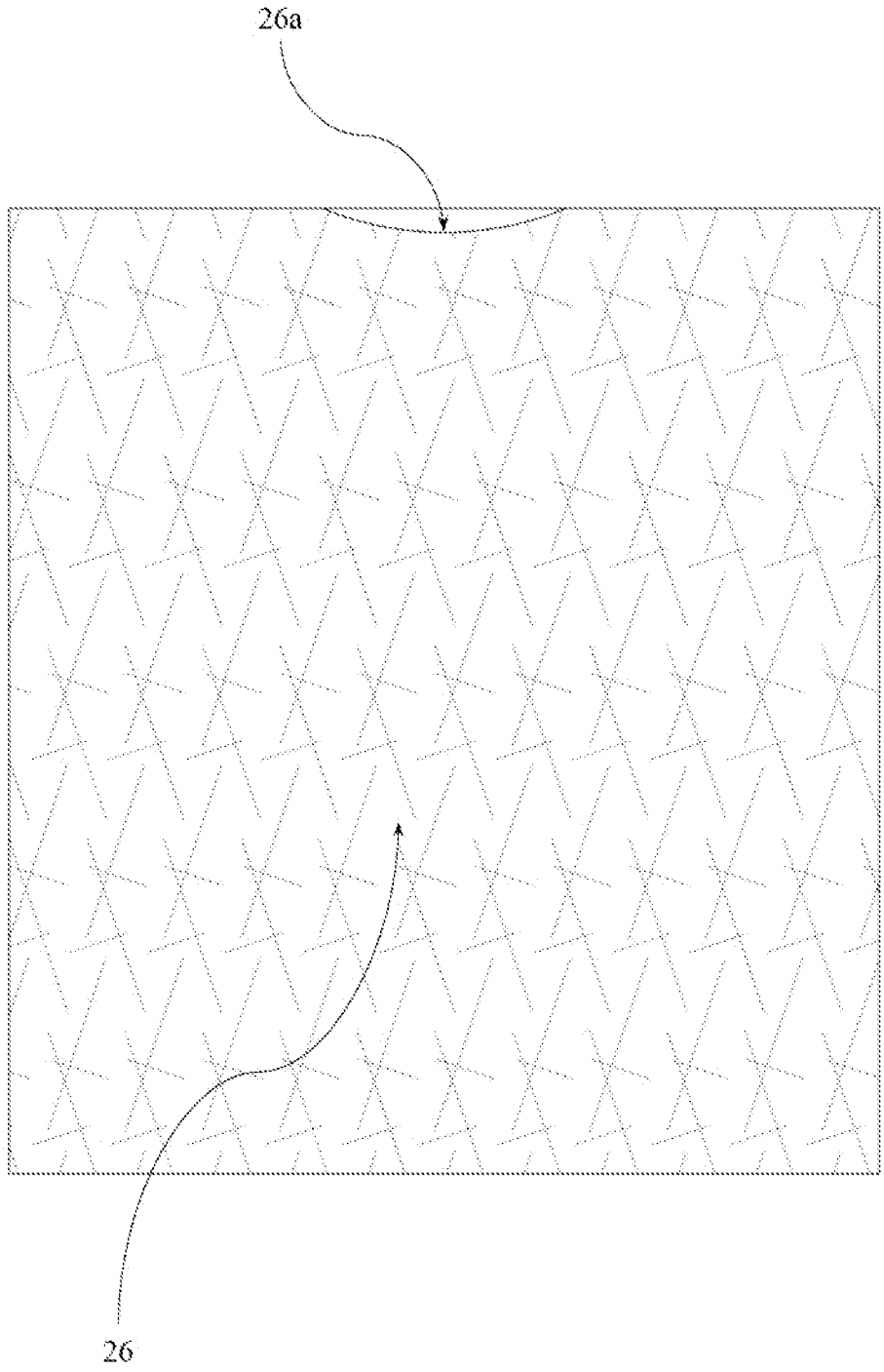
FIG. 5 is a cross-sectional view of a liquid absorbing media according to a second embodiment of the present invention.
Figure 6:
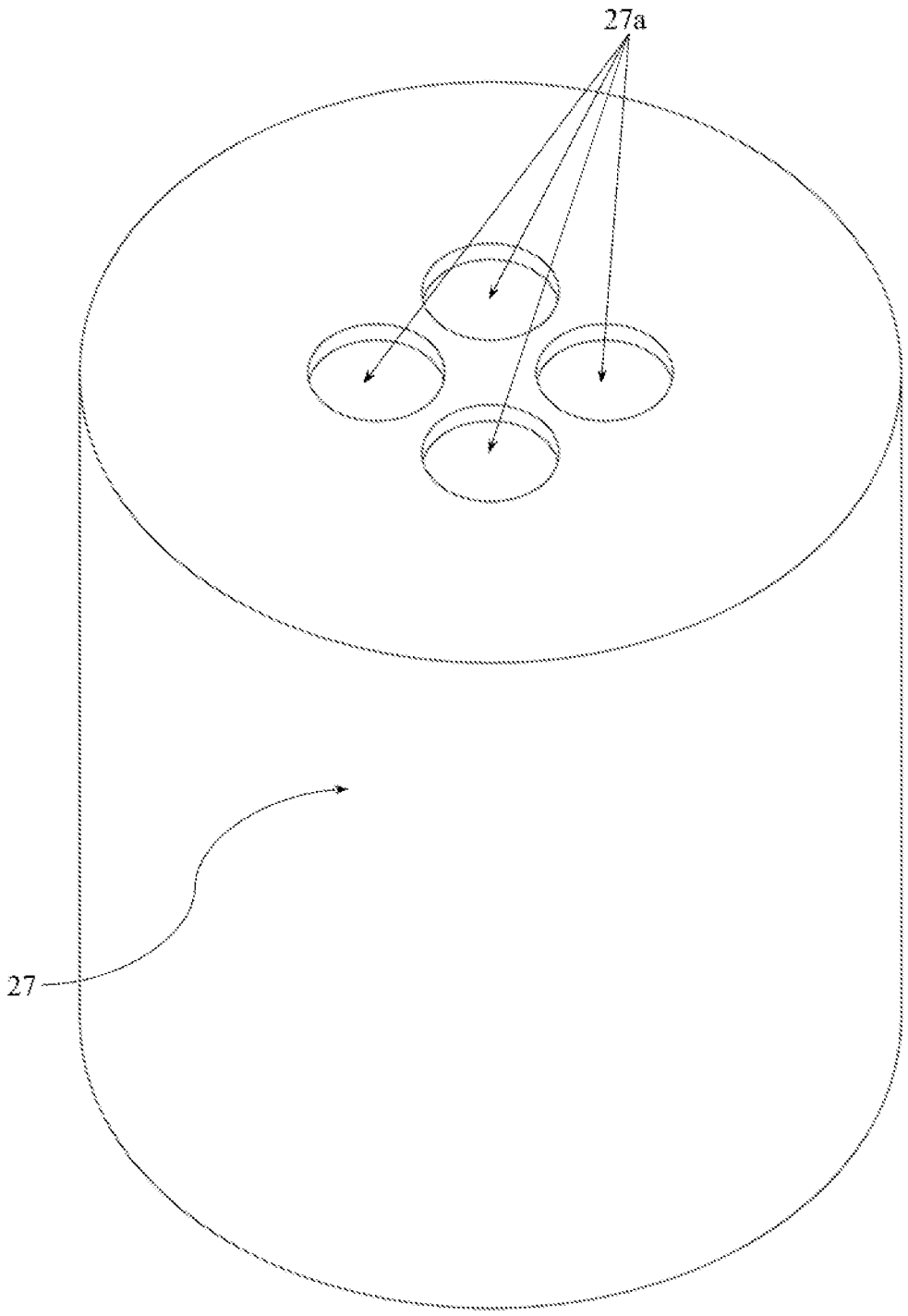
FIG. 6 is a perspective view of a liquid absorbing media according to a third embodiment of the present invention.

In addition, the geometry of the sunk area or space is not limited to cylindrical, and the number of the sunk areas needs not necessary to be one. FIG. 5 is a cross-sectional view of a liquid absorbing medium according to a second embodiment of the present invention. As seen, an arc-shaped sunk space 26*a* is introduced in an absorbing medium 26. The dimension of the arc-shaped sunk area or space can be varied with the viscosity of the liquids and the properties of the atomizer FIG. 6 is a perspective view of another liquid absorbing medium according to a third embodiment of the present invention, in which four separate cylindrical sunk areas 27*a* are introduced in an absorbing medium 27. The number of the sunk area(s) is determined by practical applications.

Figure 7:
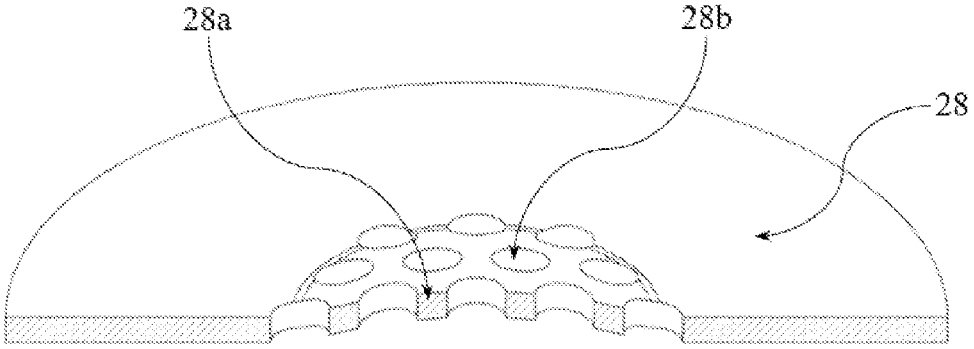
FIG. 7 is a cross-sectional view of an atomizing membrane according to a fourth embodiment of the present invention.

Further, the shape of the micro-perforated membrane needs not to be flat. FIG. 7 is a cross-sectional view of a micro-perforated membrane according to a forth embodiment of the present invention. An arched protuberance 28*a* is formed in the central of the micro-perforated membrane 28. The phrase "arched protuberance" should be understood to mean that the geometry of the protuberance may be flattened in to a plateau. The dimension of the protuberance can be varied with different applications. Micro-perforations 28*b* are also disposed in the central portion of the micro-perforated membrane 28 and intercalated with the arched protuberance 28*a*.

Figure 8:
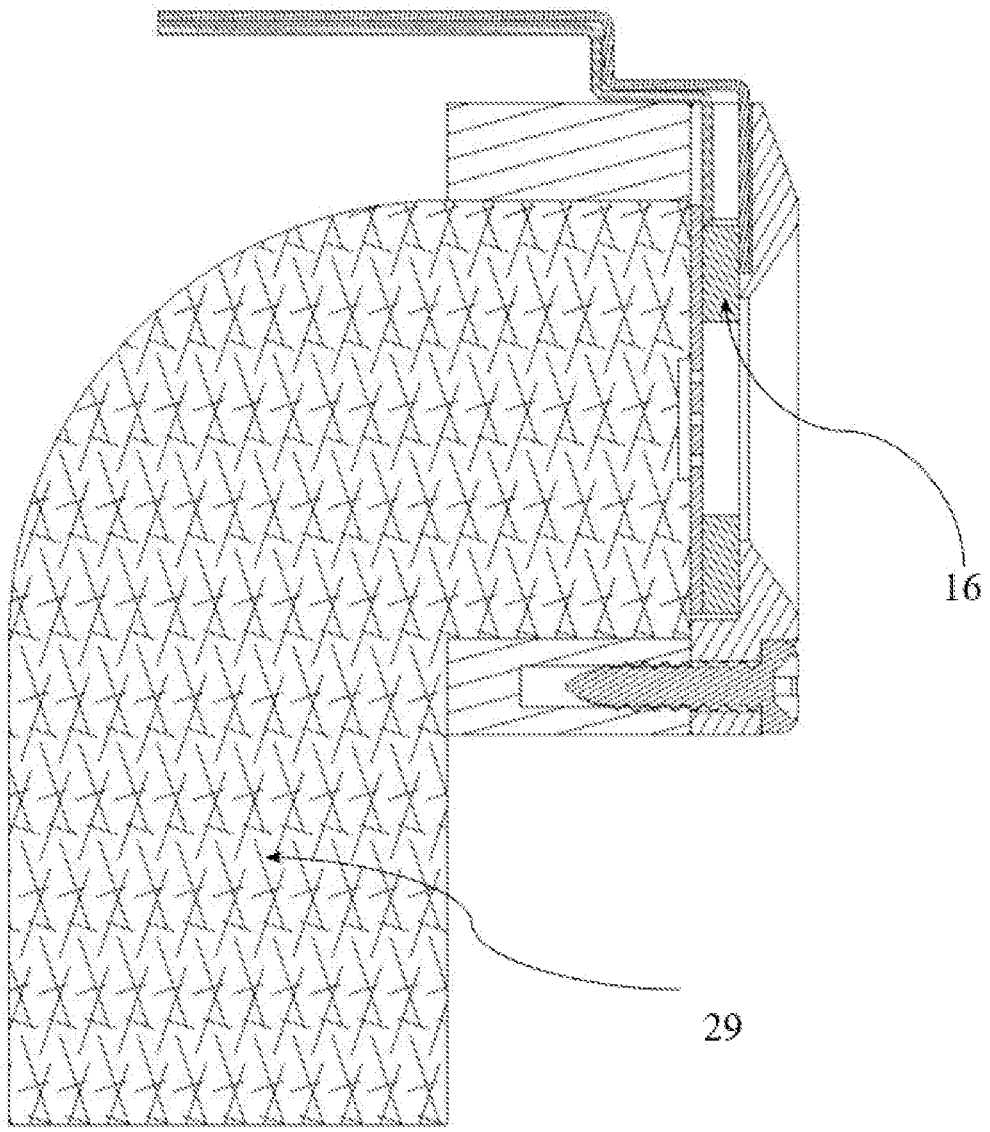
FIG. 8 is a cross-sectional of a horizontally arranged piezoceramic based nozzle according to a fifth embodiment of the present invention.

It is important to note that the direction of the nozzle can be arbitrary, varying from vertical to horizontal. FIG. 8 is a cross-sectional view of a horizontally oriented nozzle according to a fifth embodiment of the present invention. It is shown that, by using a bent liquid absorbing medium 29, the nozzle can be placed horizontally. When the vertical end of the bent liquid absorbing medium 29 is immersed in the liquid, it will absorb liquid and then transfer to the other end contacting with the piezoceramic based atomization unit 16. Thus, as discussed hereinbefore, droplets of liquid can be ejected from the nozzle horizontally when stimulated by the external ultrasonic oscillation circuit.

Hereinafter, the operation of the piezoceramic based atomizer for high viscosity liquid according to present invention will be briefly described.

Figure 9:
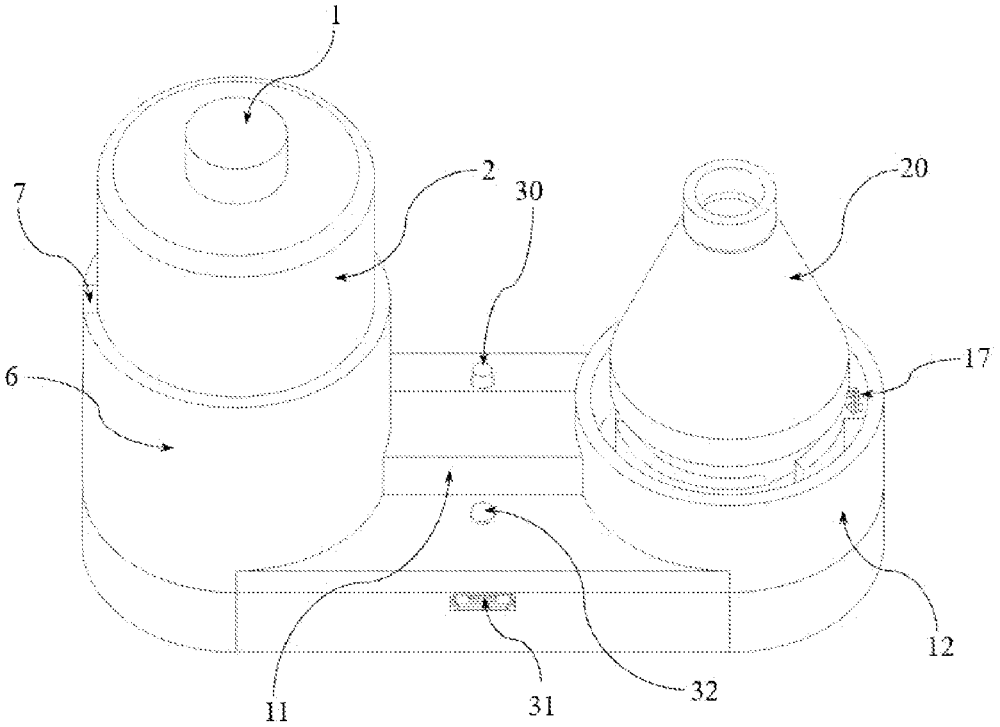
FIG. 9 is a perspective view of a piezoceramic based atomizer for high viscosity liquids according to the preferred embodiment of the present invention.

FIG. 9 is a perspective view of the piezoceramic based atomizer according to the preferred embodiment of the present invention. Before switching on the atomizer, the storing tank 2 is filled with high viscosity liquid from the filling cap 1. The viscosity of the liquid used in this example is about 200 cP. The present invention is capable of atomizing liquid with viscosity of 300 cP or above. At first, the liquid will flow into the storing trench 6 and then to the receiving tank 12 through connecting channel 11. After the liquid flows into the receiving tank 12, the liquid absorbing medium 15 will absorb the liquid and transfer the absorbed liquid to the micro-perforated membrane (e.g., 16*b* as shown in FIGS. 3 and 4), and finally reaches an equilibrium in which the respective levels of liquid in receiving tank 12 and storing trench 6 are equal. A button switch 30 is used to trigger the atomizer. When the button switch 30 is turned on, the electric power is supplied to an ultrasonic oscillation circuit (not shown in FIG. 9), generating an ultrasonic stimulating signal to the piezoceramic based atomization unit 16 through conducting wires 17. Accordingly, the annular piezoceramic and the micro-perforated membrane are vibrated at ultrasonic frequency, and then ejecting droplets of the high viscosity liquids. The preferred oscillating frequency is 120 kHz for the present invention, and the outer and inner diameters of the annular piezoceramic are 16 mm and 8 mm, respectively. A LED 32 is used to indicate the working status and the battery capacity. And a mini-USB port 31 is installed for charging.

Figure 10:
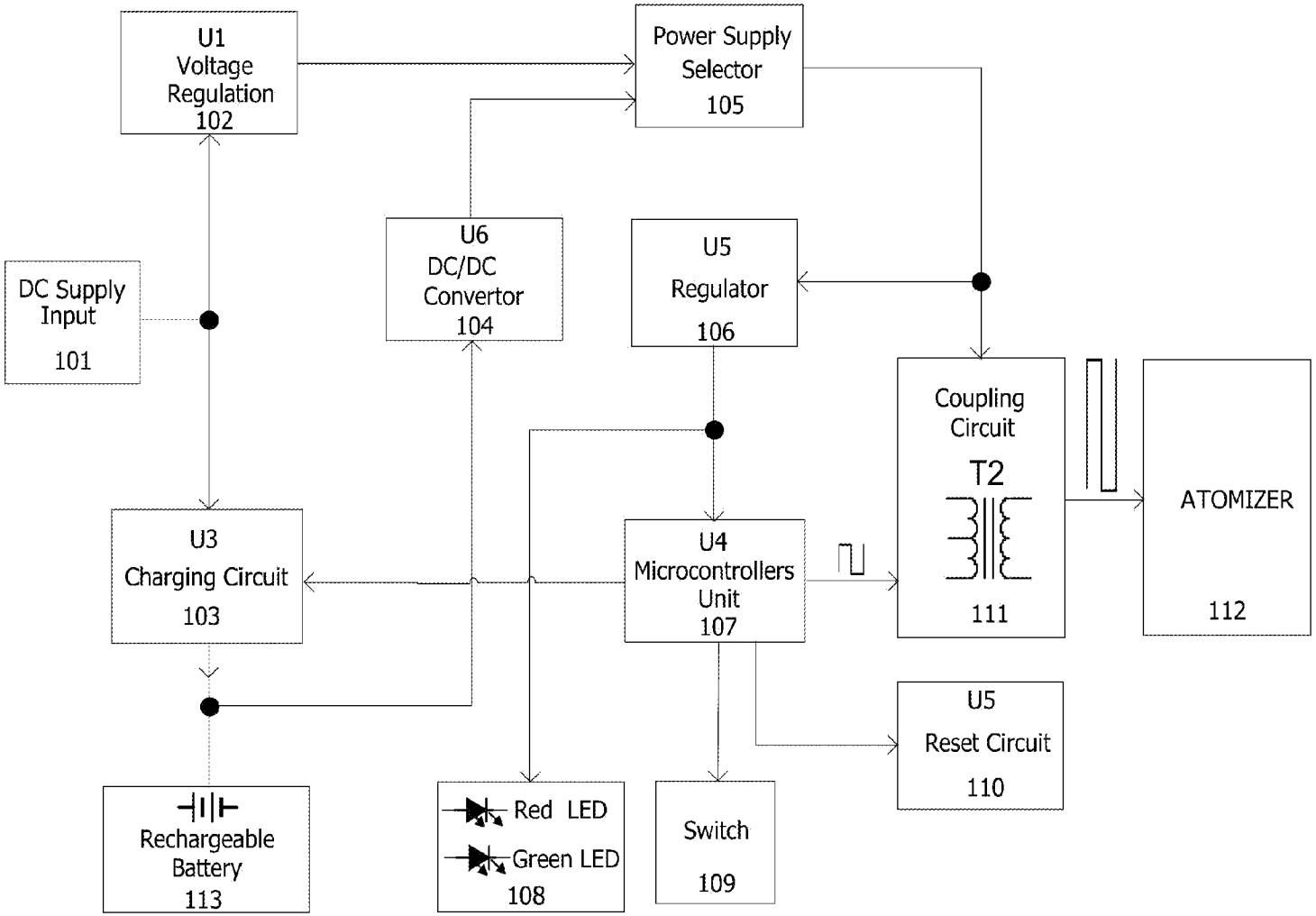
FIG. 10 is a block diagram of the controlling circuit of the piezo ceramic based atomizer according to the preferred embodiment of the present invention.
Figure 11:
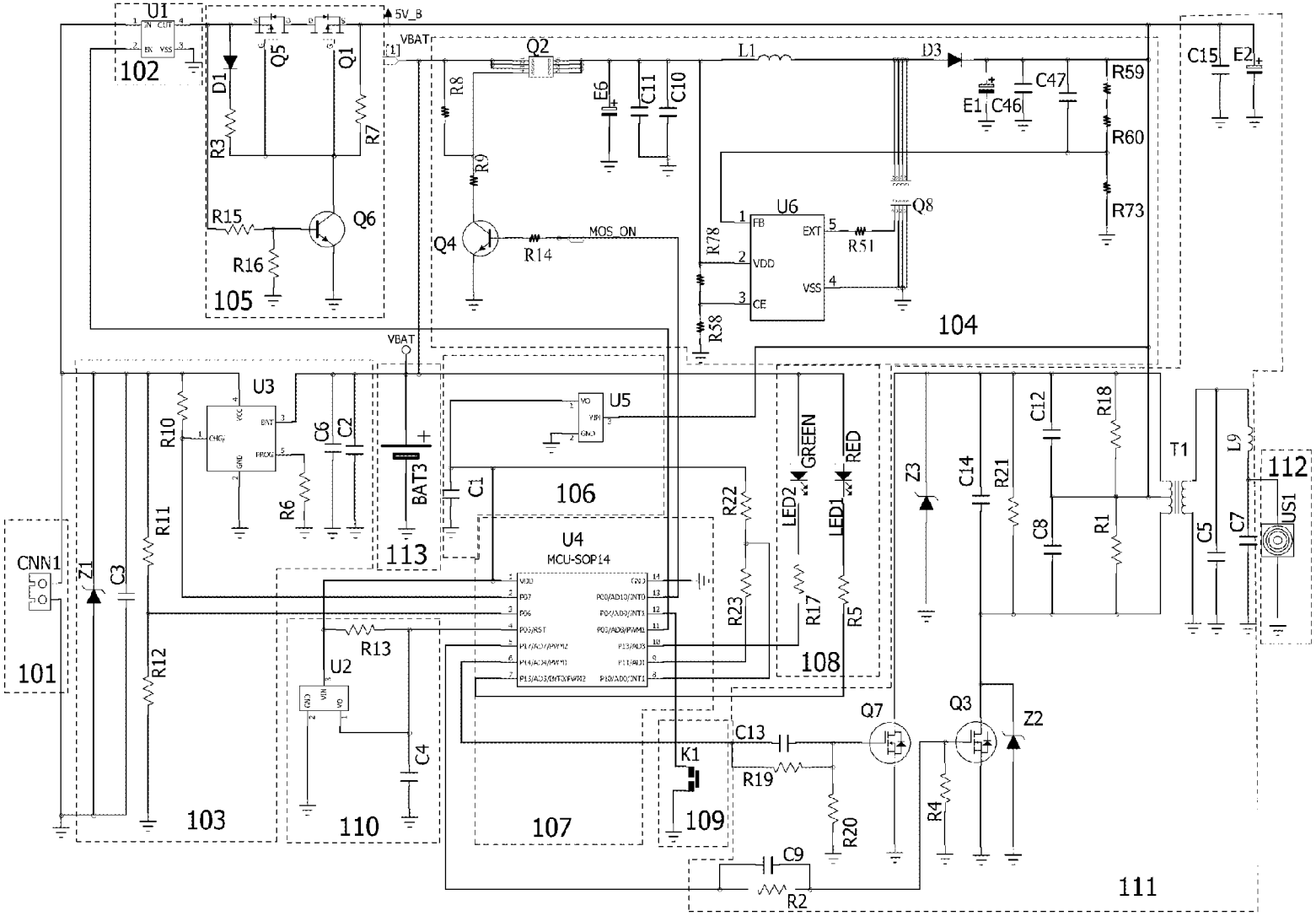
FIG. 11 is a schematic diagram of the controlling circuit of the piezoceramic based atomizer according to the preferred embodiment of the present invention.

FIGS. 10 and 11 are the respective block diagram and the schematic diagram of the controlling circuit of the piezoceramic based atomizer according to the preferred embodiment of the present invention. As seen in FIGS. 10 and 11, the external controlling circuit (or the external ultrasonic oscillation circuit) of a piezoceramic based atomizer for high viscosity liquids is composed of 13 functional modules (as shown in FIG. 10). The circuit can be powered by either internal battery or external DC source, and the detailed working principles are described as follows:

For external DC source: the external DC source 101 is divided into two branches, one enters the charging module 103 to charge the internal battery 113; the other enters the voltage regulator 102, then flows through the source selecting switch 105 to the coupling boost transformer 111 and the voltage regulator 106 that power MCU 107. When triggering the switch 109, the MCU 107 receives a working instruction and outputs a 100 kHz pulse signal. The pulse signal is then received by the boosting coil of the transformer 111, generating a 100 kHz high-voltage pulse with amplitude in the range of 50 V-500 V. The high-voltage pulse will stimulate the piezoceramic based atomization unit 112 to vibrate the piezoceramic at ultrasonic frequency, and then eject micro-droplets of liquids.

For internal battery: without DC source 101 input, the voltage of the internal battery 113 is firstly increased and stabilized to 5 V by the DC step-up module 104. Then the above 5 V DC input is tuned by the source selecting switch 105, flows to the coupling boosting transformer 111 and voltage regulator 106 that power the MCU 107. When the switch 109 is triggered on, a 100 kHz pulse signal is generated by the MCU 107 and then received by the boosting coil of the transformer 111, producing a 100 kHz high-voltage pulse. As described hereinbefore, the high-voltage pulse will stimulate the piezoceramic based atomization unit 112 and the piezoceramic is vibrated at ultrasonic frequency, as a result, the liquid is atomized.

The MCU 107 will drive the LED indicator 108 through internal checking of the working status of the battery. When low battery status is detected by the reset circuit 110, a reset instruction is sent to MCU 107, then making itself to reset and shut down.

Although several embodiments of the present invention have been described and illustrated in detail, it is understood that numerous modifications and redesigning will be easily made by those skilled in the art. Thus, the present invention is not limited to the certain embodiments described, and accordingly, all such modifications and equivalents are regarded as including within the scope of the appended claims.

INDUSTRIAL APPLICABILITY

The present invention is useful in atomizing a variety of liquids, especially high viscosity liquid. Because of this advantage, the atomizer of the present invention is applicable in different sections including medicinal, engineering and also other consumer products requiring atomization of high viscosity liquid and/or non-aqueous liquid. Some of the components or modules of the present atomizer are also applicable to the conventional atomizers to improve their performance.

What is claimed is:

1. A piezoceramic based atomizer for atomizing a liquid into a form of micro-droplet or mist, comprising:

a piezoceramic based atomization unit comprising:

at least one micro-perforated membrane, wherein an individual micro-perforated membrane comprises an upper surface, a lower surface opposite to the upper surface, and one or more micro-holes, the one or more micro-holes linking the upper and lower surfaces for allowing the liquid to penetrate the individual micro-perforated membrane from the lower surface to the upper surface; and at least one annular piezoceramic configured to vibrate the at least one micro-perforated membrane so as to atomize the liquid at the upper surface of the individual micro-perforated membrane into droplets;

and a liquid absorbing medium having a top surface and a bottom surface opposite to the top surface for absorbing the liquid at the bottom surface and delivering the absorbed liquid to the top surface, wherein the top surface contacts the lower surface of the individual micro-perforated membrane for allowing the absorbed liquid to wet the lower surface of the individual micro-perforated membrane;

wherein:

the liquid absorbing medium further comprises at least one sunk area recessed from the top surface, causing the lower surface of the individual micro-perforated membrane not in contact with the top surface over the at least one sunk area; and the at least one sunk area is disposed underneath the one or more micro-holes of the individual micro-perforated membrane, preventing the one or more micro-holes from pumping the liquid directly from the liquid absorbing medium to thereby balance a liquid feeding speed and an atomization speed, and suppress overheating of the piezoceramic based atomization unit simultaneously.

2. The atomizer of claim 1, wherein said liquid absorbing medium is bendable from linear to 90 degrees.

3. The atomizer of claim 1, wherein the individual micro-perforated membrane is adhered to the at least one annular piezoceramic.

4. The atomizer of claim 3, wherein:

the individual micro-perforated membrane is substantially flat or protuberant, and the total area of the one or more micro-holes on the individual micro-perforated membrane is smaller than the inner area of the at least one annular piezoceramic;

the individual micro-perforated membrane has a thickness from 20 to 400 um; and each micro-hole of the individual micro-perforated membrane has a diameter ranging from 1 um to 300 um.

5. The atomizer of claim 1, further comprising a storing tank for storing the liquid which communicates with the bottom surface of the liquid absorbing medium.

6. The atomizer of claim 5, wherein a liquid level control valve is installed in an exit of the storing tank to adjust a liquid level relative to the upper surface of the individual micro-perforated membrane.

7. The atomizer of claim 1, further comprising an external ultrasonic oscillation circuit for generating an ultrasonic vibrating signal to stimulate the at least one annular piezoceramic to thereby drive the at least one micro-perforated membrane to vibrate, wherein the ultrasonic vibrating signal is generated with an output frequency ranging from 50 kHz to 5 MHz and an output amplitude ranging from 50 V to 500 V.

8. The atomizer of claim 1, further comprising a mist guiding tube for orienting mist and recycling the liquid.

9. The atomizer of claim 1, further comprising at least one LED for indicating a working status and a power level of the atomizer.

10. The atomizer of claim 1, further comprising at least one switch for controlling a power supply that powers the atomizer.

* * * * *